US006658725B1

(12) United States Patent
Liu

(10) Patent No.: US 6,658,725 B1
(45) Date of Patent: Dec. 9, 2003

(54) APPARATUS FOR FORMING A CRIMPED ELECTRICAL JOINT

(75) Inventor: Dangrong Ronald Liu, West Bloomfield, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 0 days.

(21) Appl. No.: 09/567,715

(22) Filed: May 10, 2000

(51) Int. Cl.[7] ..... H01R 43/042

(52) U.S. Cl. ..... 29/753; 29/748; 29/751; 29/761; 29/33 M; 29/863; 29/865; 72/416

(58) Field of Search ..... 29/753, 861, 865, 29/866, 867, 748, 749, 750, 751; 72/412

(56) References Cited

U.S. PATENT DOCUMENTS 5,490,801 A * 2/1996 Fisher et al. ..... 439/585
5,745,982 A * 5/1998 Klinedinst ..... 29/753
6,438,823 B2 * 8/2002 Yamakawa ..... 29/753

* cited by examiner

*Primary Examiner*—Richard Chang

(57) ABSTRACT

A method and an apparatus for forming a crimped joint in an electrical wire terminal. The apparatus forms a crimped joint and substantially simultaneously bends and/or twists the terminal and electrical wire about their respective longitudinal axes, effective to reduce electrical contact resistance within the formed joint.

6 Claims, 5 Drawing Sheets

APPARATUS FOR FORMING A CRIMPED ELECTRICAL JOINT

FIELD OF THE INVENTION

This invention generally relates to a method and to an apparatus for forming a crimped joint and more particularly, to a method and to an apparatus for forming a crimped joint in an electrical wire terminal and which provides reduced electrical contact resistance within the formed joint.

BACKGROUND OF THE INVENTION

Crimped joints are commonly used in electrical systems, such as automotive electrical systems, in order to selectively and electrically interconnect electrical components. For example and without limitation, crimped joints are used in electrical wire harnesses which electrically interconnect various components or portions of an automobile. Particularly, crimped joints are used to couple electrical connectors or terminals to the ends of the wires in the harness in order to facilitate the connection of the wires to various components, devices or other terminals.

These types of crimped joints are typically formed by use of a die set (e.g., a punch and an anvil) which are selectively used to compress and/or deform a "barrel" portion of the terminal in which the electrical wire resides. Particularly, the electrical wire is placed in the "barrel" portion of the terminal which is subsequently compressed by the die set. As the die set is compressed, two "wings" or flanges which typically form the barrel portion of the terminal are bent downward into the wire bundle. Further compression of the die set further deforms the barrel and tightly packs the strands of the wire bundle together, thereby forming a crimped joint.

While these types of crimped joints are effective to relatively quickly connect terminals to the ends of electrical wires, they suffer from some drawbacks and are generally considered a "weak link" in the wiring harness. For example and without limitation, when compared with other permanent electrical connection methods (e.g., soldering), crimped joints typically show higher initial contact resistance and have a greater tendency to introduce electrical failure within a wiring harness over their respective service lives. One cause of the relatively high contact resistance in these types of crimped joints arises from resistive material (e.g., "oxides") which resides on the outer surfaces of the various strands of the electrical wire and on the inner surfaces of the terminal barrel. The crimping process and die set generate primarily only "normal" type forces between the wire strands which are not effective to remove a significant amount of the resistive material from the wire strands and from the terminal barrel. Furthermore, attempts at removing these resistive materials or oxides prior to forming the crimped joint are excessively costly and/or time consuming.

There is therefore a need for a method and an apparatus for forming a crimped joint which overcomes the previously delineated drawbacks of prior methods and apparatuses and which provides a crimped joint having a reduced amount of contact resistance.

SUMMARY OF THE INVENTION

It is a first object of the present invention to provide a method and an apparatus for selectively forming a crimped joint in an electrical wire terminal or connector which overcomes the previously delineated disadvantages of prior automotive electrical interconnection schemes and systems.

It is a second object of the present invention to provide a method and apparatus for forming a crimped joint in an electrical wire terminal or connector which provides a joint having reduced contact resistance.

It is a third object of the present invention to provide a method and an apparatus for forming a crimped joint between an electrical wire and a terminal barrel which automatically causes oxides to be removed from the surfaces of the electrical wire and the terminal barrel, thereby forming a joint with reduced contact resistance.

According to one aspect of the present invention, an apparatus for forming a crimped joint is provided. The apparatus forms a crimped joint between an electrical wire terminal having a first longitudinal axis and a barrel portion having an interior surface, and a wire having an exterior surface which is disposed within the barrel portion and a second longitudinal axis. The apparatus includes a first die member having a first surface which is concave relative to the first and second longitudinal axes; and a second die member having a second surface which is convex relative to the first and second longitudinal axes and which is adapted to selectively engage the barrel portion and to cooperate with the first die member to deform the barrel portion effective to form a crimped joint between the wire and the terminal and to bend the barrel portion and the wire respectively along the first and second longitudinal axes, the longitudinal bending being effective to cause the interior surface of the barrel portion to slide longitudinally relative to the exterior surface of the wire, thereby reducing contact resistance between the barrel portion and the wire.

According to a second aspect of the present invention, a method is provided for forming a crimped joint having reduced contact resistance. The crimped joint is formed between a terminal having a hollow barrel portion with an inner surface and an electrical wire having an outer surface. The method includes the steps of disposing the electrical wire within the hollow barrel portion; deforming the hollow barrel portion effective to compact the barrel portion and the wire, thereby forming the crimped joint; and twisting the barrel portion and the electrical wire about their respective longitudinal axes, effective to cause the inner surface of the barrel portion to slide relative to the outer surface of the electrical wire, thereby reducing the contact resistance within the crimped joint.

Further objects, features, and advantages of the present invention will become apparent from a consideration of the following description and claims when taken in conjunction with the accompanying drawings.

DETAILED DESCRIPTION OF THE PREFERRED EMBODIMENT OF THE INVENTION

Figure 1:
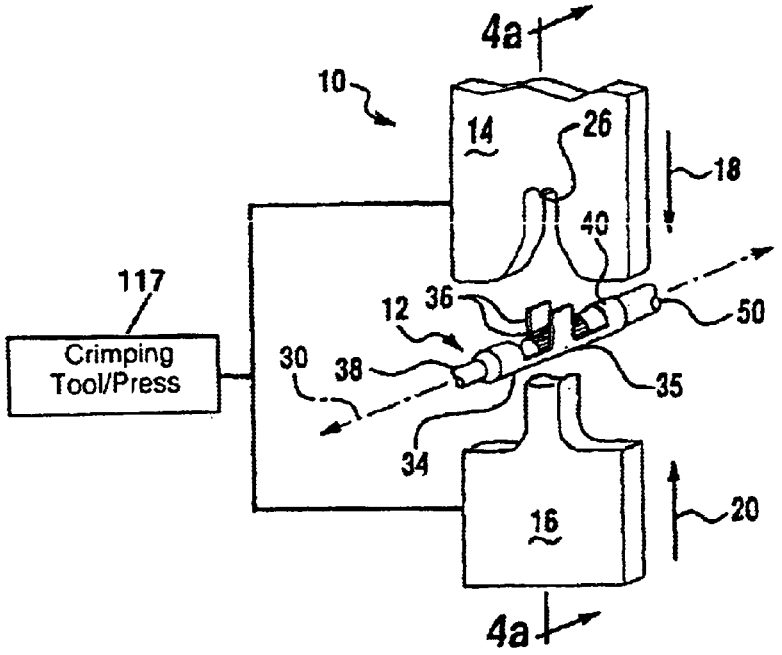
FIG. 1 is an apparatus for forming a crimped joint between an electrical wire and a wire terminal and which is made in accordance with the teachings of the present invention.

Referring now to FIG. 1, there is shown an apparatus 10 which is made in accordance with the teachings of the preferred embodiment of the invention and which is effective to form a crimped joint in an electrical connector assembly or wire terminal 12. As shown, apparatus 10 includes a pair of die pieces or members 14, 16. It should be appreciated that members 14, 16 may be operatively coupled and/or attached in a conventional manner to a conventional manual and/or mechanical crimping tool (not shown) , such as a hand-held crimping tool or a mechanical press, which is effective to move and/or force the members 14, 16 together in the directions of arrows 18, 20.

Figure 2:
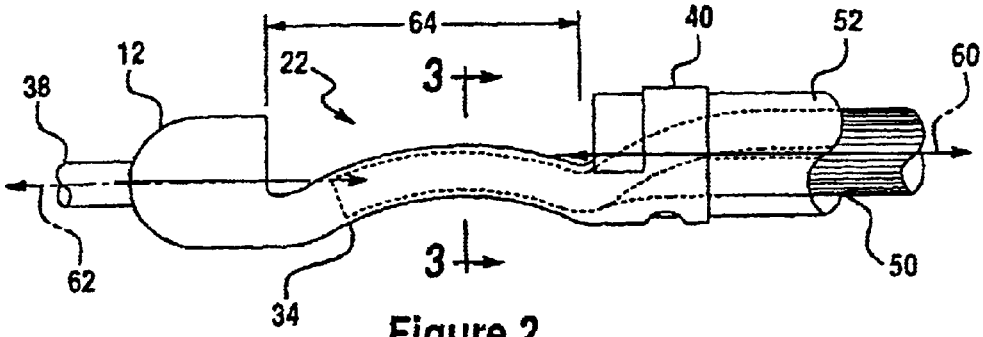
FIG. 2 is a side view of a crimped joint which is formed by use of the apparatus shown in FIG. 1.
Figure 3:
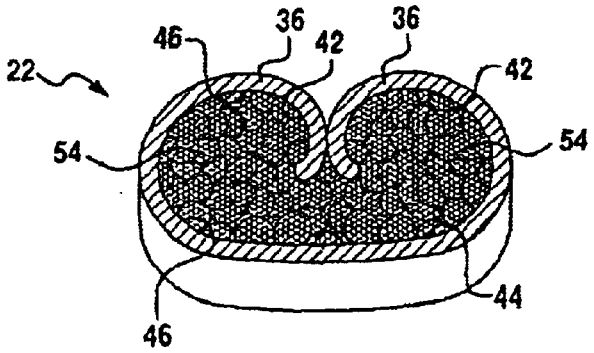
FIG. 3 is a sectional view of the crimped joint shown in FIG. 2 and taken along view line 3—3.

In the preferred embodiment of the invention, member 14 comprises a conventional "anvil" type member and member 16 comprises a conventional "punch" type member which cooperates with anvil member 14 to form a crimped joint in terminal 12, such as joint 22 illustrated in FIGS. 2 and 3. As shown best in FIG. 4*b*, die member 14 includes a pair of substantially identical curved or "arched" surfaces 24 which meet at a ridge 26 which is substantially aligned with (e.g., is parallel to) the horizontal axis 30 that resides between members 14, 16 and which intersects the vertical axis of symmetry 28 of apparatus 10. As shown best in FIG. 4*a*, surfaces 24 are also curved inward with respect to the horizontal axis 30 (i.e., surfaces 24 are concave relative to axis 30).

Figure 4A:
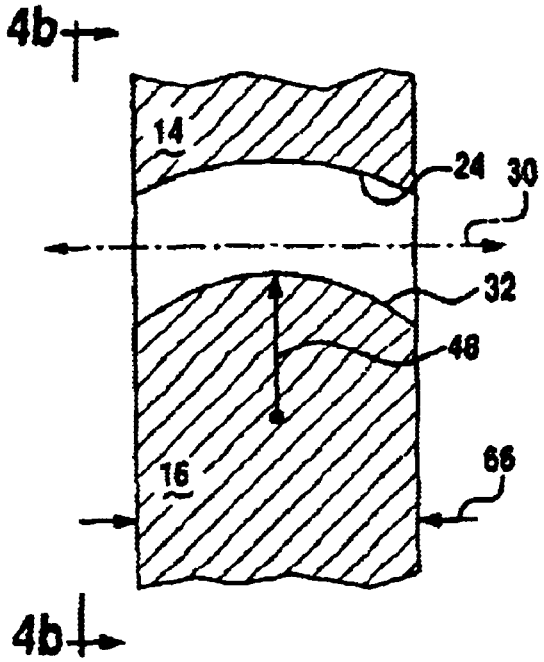
FIG. 4*a* is a sectional view of the crimping apparatus shown in FIG. 1 and taken along view line 4*a*—4*a*.
Figure 4B:
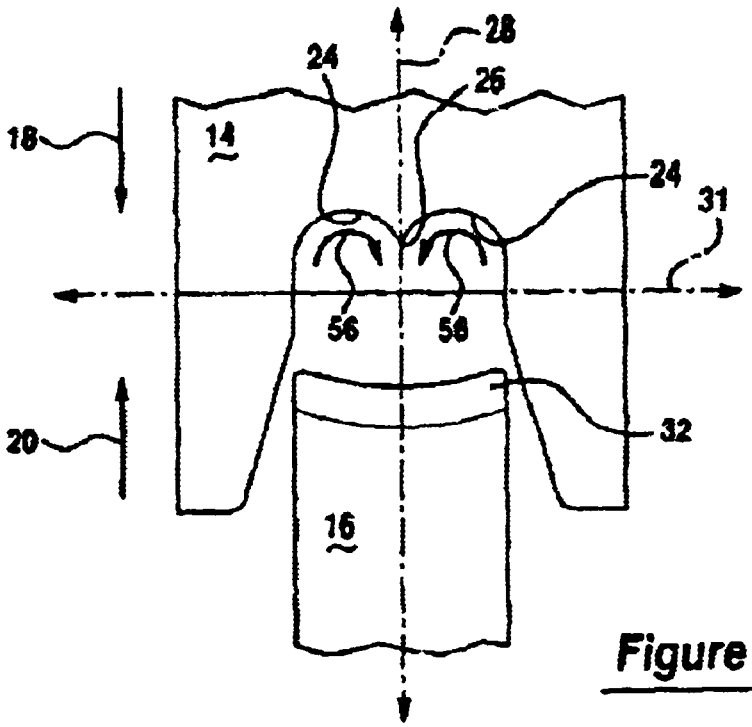
FIG. 4*b* is a sectional view of the crimping apparatus shown in FIG. 4*a* and taken along view line 4*b*—4*b*.

Die member 16 includes an outer surface 32 which is curved outward with respect to axis 30 of apparatus 10 (i.e., surface 32 is convex relative to axis 30), as illustrated in FIG. 4*a*. Surface 32 is also curved slightly inward with respect to the transverse axis 31 which is perpendicular to axis 28 and axis 30 (i.e., surface 32 is slightly concave relative to axis 31). This slight "inward" curvature of surface 32 is adapted to conform to and/or engage the bottom surface 35 of terminal 12.

Electrical wire 50 includes a generally cylindrical insulating shell or casing 52 which holds a plurality of bundled electrically conductive wire strands or fibers 54. Terminal 22 is made from a conductive and relatively deformable metal material. Terminal 22 includes a generally "U"-shaped crimping or "barrel" portion 34 having a pair of substantially identical vertically extending "wings" or flanges 36 which are selectively deformed or crimped by apparatus 10, as described more fully and completely below. Terminal 22 further includes an electrical connecting portion or end 38 and a generally cylindrical hollow portion 40 which selectively and conventionally engages insulating cover 52.

In operation, wire 50 is inserted into terminal 22, as shown in FIG. 1, such that the bundle of wire strands 54 is disposed substantially within barrel portion 34 and the longitudinal axis 60 of wire 50 and the longitudinal axis 62 of terminal 22 are substantially aligned with axis 30 (e.g., such that surfaces 24 are concave relative to axes 60, 62 and surface 32 is convex relative to axes 60, 62). Die members 14 and 16 are then forced together (e.g., in the directions of arrows 18 and 20) in a conventional manner (e.g., die members 14, 16 are attached to a crimping tool). As die members 14 and 16 are forced together, flanges 36 engage surfaces 24 and are deformed or bent downward in the direction of arrows 56. Flanges 36 move downward and engage wire strands 54 and compress and/or pack the wire strands 54, thereby tightly compacting the wire strands together, as shown best in FIG. 3. As flanges 36 compress wires 54, the generally convex surface 32 of die 16 and the concave surface 34 of die 14 cooperate to deform or bend barrel 34 and wire strands 54 along and/or relative to the longitudinal axis 60 of wire 50 and the longitudinal axis 62 of terminal 22, as shown best in FIG. 2.

The deformation or bending of barrel portion 34 and wire strands 54 along and/or relative to their respective longitudinal axes 62, 60 reduces the electrical contact resistance of the resulting crimped joint 22 and improves the quality of the electrical connection provided by the crimped joint 22 relative to prior crimped joints. Particularly, as barrel portion 34 is deformed and/or bent along axis 62, the upper inner surfaces 42 and the lower inner surface 44 of the barrel 34 experience sliding against all wire strands 54 which are in contact with the respective surfaces 42, 44 due to the angular deformation of the barrel relative to wire strands 54. This "sliding" action is caused by a shear force which is generated along the wire bundle and which cause the surfaces in contact (e.g., surfaces 42, 44, and 46) to slide against each other in the longitudinal direction (e.g., the bending of wire strands 54 "lags" behind the bending of barrel 34, thereby causing relative longitudinal movement between the strands 54 and barrel 34). This relative sliding motion causes the oxides and other resistive materials on the exterior or outer surfaces 46 of wire stands 54 and on the interior or inner surfaces 42, 44 of barrel 34 to be "wiped" away. This oxide removal results in a significant reduction in contact resistance between barrel 34 and wire 50. It should further be appreciated that apparatus 10 allows oxides to be removed from barrel 34 and wire strands 54 substantially simultaneously with the formation of joint 22 and without performing any additional steps in the crimping process. In alternate embodiments, the length 64 of barrel 34 and the thickness 66 of die members 14, 16 may be increased, or the radius of curvature 48 of member 16 may be altered, to provide for a greater amount of sliding motion between wire strands 54 and surfaces 42, 44. In other alternate embodiments, additional curves may be formed within die members 14, 16 to provide for additional bends (e.g., double bending) in crimped joint 22.

Figure 5:
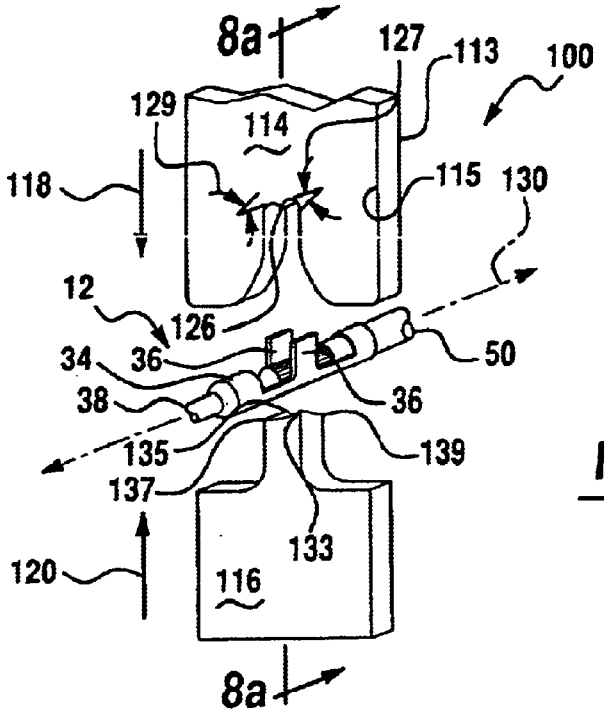
FIG. 5 is an apparatus for forming a crimped joint between an electrical wire and a wire terminal which is made in accordance with the teachings of an alternate embodiment of the present invention.

Referring now to FIG. 5, there is shown an apparatus 100 which is made in accordance with the teachings of an alternate embodiment of the Invention and which is effective to form a crimped joint in an electrical connector assembly or wire terminal 12. As shown, apparatus 100 includes a pair of die pieces or members 114, 116. It should be appreciated that members 114, 116 may be operatively coupled and/or attached in a conventional manner to a conventional manual and/or mechanical crimping tool (not shown), such as a hand-held tool or a mechanical press 117, which is effective to move and/or force the members 114, 116 together in the directions of arrows 118, 120.

Figure 6:
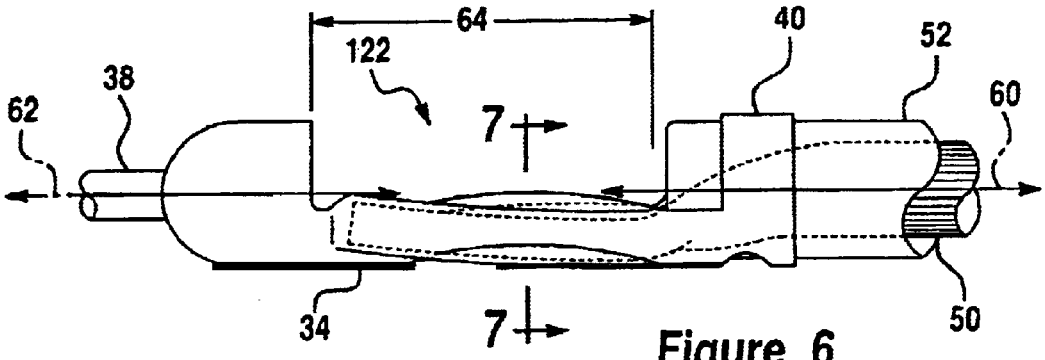
FIG. 6 is a side view of a crimped joint which is formed by use of the apparatus shown in FIG. 5.
Figure 7:
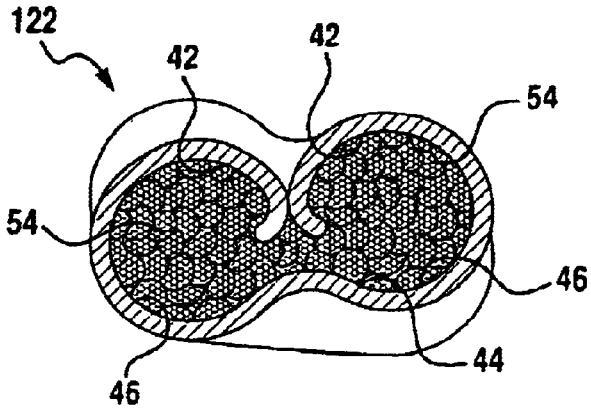
FIG. 7 is a sectional view of the crimped joint shown in FIG. 6 and taken along view line 7—7.
Figure 8A:
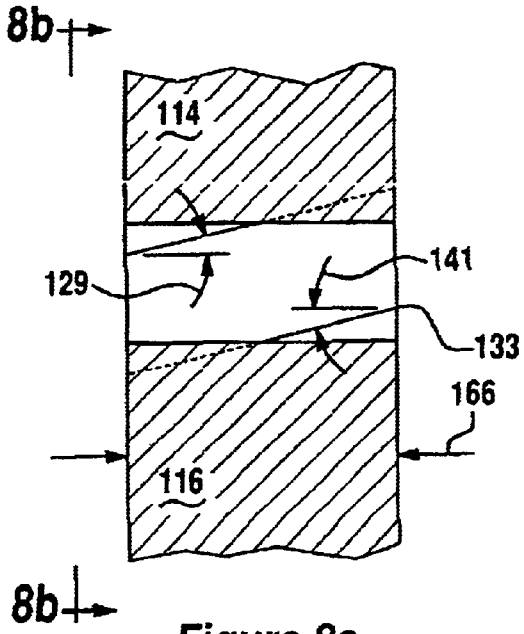
FIG. 8*a* is a sectional view of the crimping apparatus shown in FIG. 5 and taken along view line 8*a*—8*a*.
Figure 8B:
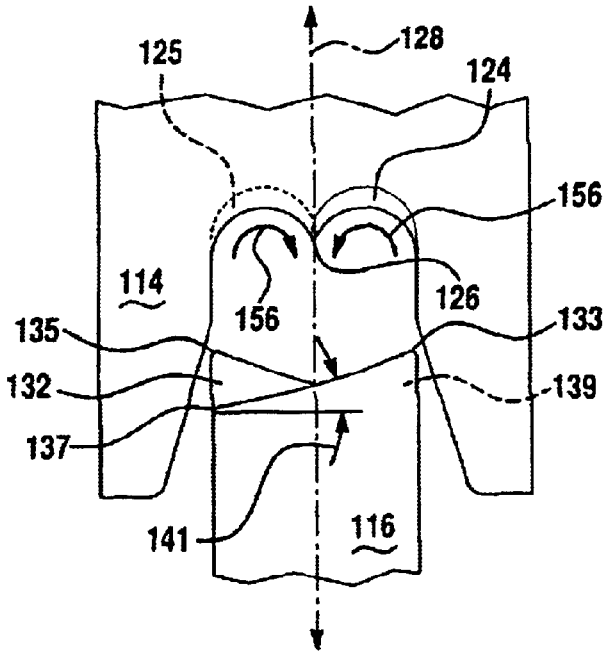
FIG. 8*b* is a sectional view of the crimping apparatus shown in FIG. 5 and taken along view line 8*b*—8*b*.
Figure 9:
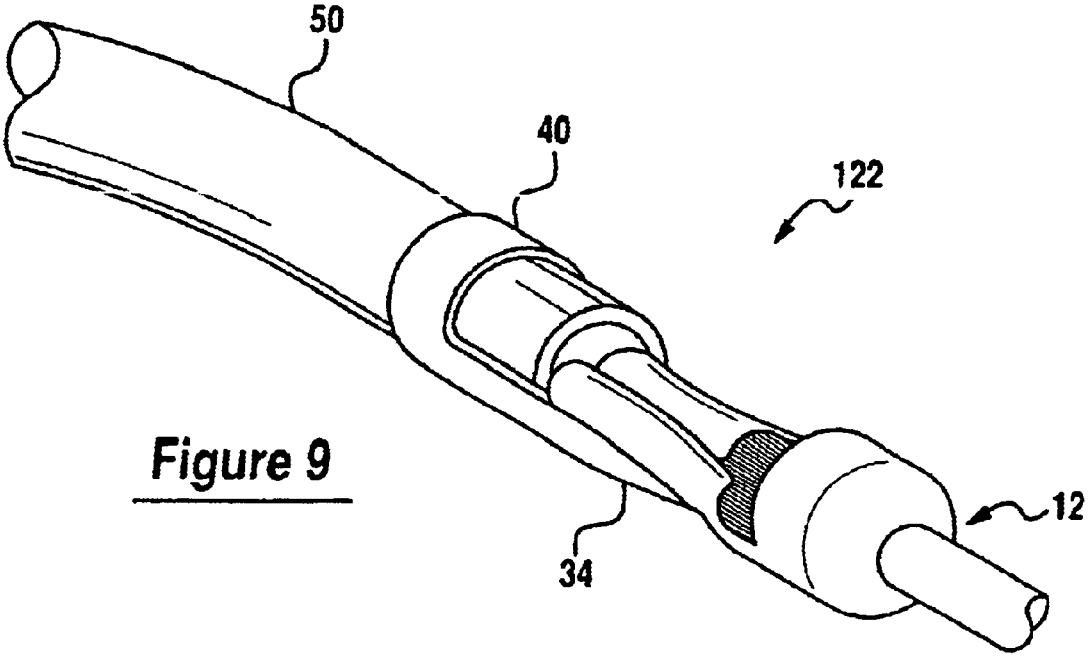
FIG. 9 is a perspective view of a the crimped joint shown in FIG. 6.

In the preferred embodiment of the invention, member 114 comprises a conventional "anvil" type member and member 116 comprises a conventional "punch" type member which cooperates with anvil member 114 to form a crimped joint in terminal 12, such as joint 122 illustrated in FIGS. 6, 7 and 9. As shown best in FIG. 8*b*, die member 114 includes a pair of substantially identical curved or "arched" surfaces 124, 125 which meet at a ridge 126 which passes through the vertical axis of symmetry 128 of apparatus 10. As shown best in FIG. 8*a*, surfaces 124, 125 are each angled or sloped in opposite directions with respect to the horizontal (e.g., relative to the horizontal axis 130 disposed between die members 114, 116). Particularly, surface 124 is sloped upward from the back surface 113 of die 114 to the front surface 115 of die 114 at an angle 127. Furthermore, surface 125 is sloped upward from the front surface 115 of die 114 to the back surface 113 at an angle 129. In the preferred embodiment of the invention, angles 127 and 129 are substantially identical and in one non-limiting embodiment are each equal to approximately 20 degrees.

As shown best in FIG. 8*b*, die member 116 includes an "upper" or barrel-engaging surface 132 which includes a pair of opposing raised corners 133, 135 and a pair of opposing recessed corners 137, 139. Surface 132 is sloped downward from each raised corner 133, 135 to each recessed corner 137, 139 at an angle 141 of approximately 20 degrees. As described more fully and completely below, the sloped surface 132 of die member 116 is adapted to cooperate with surfaces 124, 125 of die member 114 to engage barrel portion 34 and to cause barrel portion 34 to "twist", as shown best in FIGS. 7 and 9, when the barrel 34 is crimped.

In operation, wire 50 is inserted into terminal 122, as shown in FIG. 5, such that the bundle of wire strands 54 is disposed substantially within barrel portion 34 and the longitudinal axis 60 of wire 50 and the longitudinal 62 of terminal 22 are each substantially aligned with axis 130. Die members 114 and 116 are then forced together (e.g., in the directions of arrows 118 and 120) in a conventional manner (e.g., die members 114, 116 are attached to a crimping tool or press). As die members 114 and 116 are forced together, flanges 36 engage surfaces 124, 125 and are deformed or bent downward in the direction of arrows 156. Flanges 36 move downward and engage wire strands 54 and compress and/or pack the wire strands 54, thereby tightly compacting the wire strands 54 together, as best shown in FIG. 7. As flanges 36 compress wires 54, the surface 132 of die 116 and the surfaces 125, 125 of die 114 cooperate to deform and/or "twist" barrel 34 and wire strands 54 respectively about (e.g., relative to) the longitudinal axis 60 of wire 50 and the longitudinal axis 62 of terminal 22, as shown best in FIGS. 7 and 9.

The deformation or twisting of barrel portion 34 and wire strands 54 about their respective longitudinal axes reduces the electrical contact resistance of the resulting crimped joint 122 and improves the electrical connection provided by the crimped joint 122 relative to prior crimped joints. Particularly, as barrel portion 34 is deformed and/or twisted about longitudinal axis 62, the upper inner surfaces 42 and the lower inner surface 44 of the barrel 34 experience sliding against all wire strands 54 which are in contact with the respective surfaces 42, 44 due to the angular deformation of the barrel 34 relative to wire strands 54. This "sliding" action is caused by a torsional or shear force which is generated along the twisting wire bundle and barrel 34 and which causes the surfaces in contact to slide against each other (e.g., the twisting of the wire strands 54 lags behind the twisting of the barrel 34, thereby causing relative movement between the strands 54 and barrel 34). This relative sliding motion causes the oxides and other resistive materials on the outer or exterior surfaces 46 of wire 50 or wire stands 54 and on the inner or interior surfaces 42, 44 of barrel 34 to be "wiped" away. This oxide removal results in a significant reduction in contact resistance between barrel 34 and wire 50. It should further be appreciated that apparatus 100 allows oxides to be removed from barrel 34 and wire strands 54 without performing any additional steps in the crimping process. In alternate embodiments, the length 64 of barrel 34 and the length 166 of die members 114, 116 may be increased, or the twisting angle (e.g., 20 degrees) which is determined by angles 127, 129 and 141 may be altered, to provide for a greater amount of twisting of barrel 34 and wires 54 and a corresponding greater amount of relative motion between the outer surfaces of wire 50 or wire strands 54 and surfaces 42, 44.

It should be understood that this invention is not limited to the exact construction or embodiments listed and described, but that various changes may be made without departing from the spirit and scope of the invention.

What is claimed is:

1. An apparatus in combination with an electrical connector and a wire, said apparatus for forming a crimped joint between the electrical connector including a barrel portion having an interior surface, a first longitudinal axis, a first and a second flange which are perpendicular to said first longitudinal axis, and the wire which comprises a plurality of bundled strands and which is disposed within said barrel portion, said wire having an exterior surface and a second longitudinal axis, said apparatus comprising:

a first die member having a first, a second, and a third surface, said first surface being concave relative to said first and second longitudinal axes, said second surface disposed between said first surface and said third surface being convex relative to said first and second longitudinal axes, said third surface being concave to said first and second longitudinal axes, wherein said first concave surface is adapted to bend said first flange in a direction towards said second surface, and wherein said third concave surface is adapted to bend said second flange in a direction towards said second surface, thereby abutting said first flange with said second flange as said first and said second flanges frictionally engage said plurality of bundled strands; and a second die member having a second surface which is convex relative to said first and second longitudinal axes and which is adapted to selectively engage said barrel portion and to cooperate with said first die member to deform said barrel portion effective to form a crimped joint between said wire and said connector and to bend said barrel portion and said wire respectively along said first and said second longitudinal axes, said bending being effective to cause said interior surface of said barrel portion to slide longitudinally relative to said exterior surface of said wire, thereby substantially removing electrically resistive material from said exterior surface of said wire and said interior surface of said barrel portion, effective to reduce contact resistance between said barrel portion and said wire.

2. The apparatus of claim 1 wherein said first die member and said second die member are each operatively coupled to a crimping tool which is effective to force said first and second die members together and to cause said second die member engage said barrel portion and said first die member.

3. The apparatus of claim 2 wherein said crimping tool comprises a hand-held tool.

4. The apparatus of claim 2 wherein said crimping tool comprises a mechanical press.

5. The apparatus of claim 1 wherein said third surface of said first die member comprises a ridge portion which is effective to bend said flanges downward when said second die member engages said barrel portion and said first die member, thereby tightly compacting said plurality of bundled strands.

6. The apparatus of claim 1 wherein said connector comprises a terminal.

* * * * *